US011512661B2

(12) United States Patent
Jo

(10) Patent No.: US 11,512,661 B2
(45) Date of Patent: Nov. 29, 2022

(54) METHOD AND DEVICE FOR DETECTING LEAKAGE OF HIGH PRESSURE FUEL PUMP OF VEHICLE

(71) Applicants: Hyundai Motor Company, Seoul (KR); Kia Corporation, Seoul (KR)

(72) Inventor: Sunmyoung Jo, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/380,493

(22) Filed: Jul. 20, 2021

(65) Prior Publication Data

US 2022/0220917 A1 Jul. 14, 2022

(30) Foreign Application Priority Data

Jan. 8, 2021 (KR) ..... 10-2021-0002475

(51) Int. Cl.
*F02D 41/22* (2006.01)
*F02N 11/08* (2006.01)

(52) U.S. Cl.
CPC ..... *F02D 41/22* (2013.01); *F02N 11/0829* (2013.01); *F02D 2041/225* (2013.01); *F02D 2041/228* (2013.01); *F02D 2200/0602* (2013.01)

(58) Field of Classification Search
CPC ..... F02D 41/22; F02D 2041/225; F02D 2041/228; F02D 2200/0602; F02N 11/0829; F02N 11/0833; F02N 11/0848
See application file for complete search history.

(56) References Cited

U.S. PATENT DOCUMENTS 5,633,458 A * 5/1997 Pauli ..... F02D 41/22 73/114.51
2010/0280741 A1* 11/2010 Wang ..... F02D 41/222 702/50
2016/0076475 A1* 3/2016 Suzuki ..... F02D 41/222 123/445
2016/0090933 A1* 3/2016 Tsutsuji ..... G01L 27/007 73/1.57
2019/0040812 A1* 2/2019 Sarwar ..... F02D 41/22

* cited by examiner

*Primary Examiner* — George C Jin
(74) *Attorney, Agent, or Firm* — Fox Rothschild LLP

(57) ABSTRACT

A method for detecting leakage of a high pressure fuel pump of a vehicle includes: turning off starting of an engine; after the starting of the engine is turned off, determining whether restarting of the engine occurs by a fuel rail pressure condition in which internal fuel pressure of a fuel rail connected between the high pressure fuel pump and an injector of the engine is less than or equal to a reference pressure; when the restarting of the engine occurs by the fuel rail pressure condition, determining whether a reference pressure reach time of the internal fuel pressure of the fuel rail is less than or equal to a reference time; and when the reference pressure reach time of the internal fuel pressure of the fuel rail is less than or equal to the reference time, storing a number of times of restarting of the engine.

6 Claims, 2 Drawing Sheets

METHOD AND DEVICE FOR DETECTING LEAKAGE OF HIGH PRESSURE FUEL PUMP OF VEHICLE

CROSS-REFERENCE TO RELATED APPLICATION

This application claims under 35 U.S.C. § 119 the benefit of Korean Patent Application No. 10-2021-0002475 filed in the Korean Intellectual Property Office on Jan. 8, 2021, the entire contents of which are incorporated herein by reference.

BACKGROUND

(a) Technical Field

The present disclosure relates to a fuel system of a vehicle, more particularly, to a method and a device for detecting a leakage of a high pressure fuel pump in the fuel system of the vehicle.

(b) Description of the Related Art

A fuel injection method of a vehicle engine may be generally divided into a port injection method and a direct injection method. The port injection method is used mainly for a gasoline engine, and is a method that injects fuel to an intake port and supplies an air-fuel mixture into a cylinder of the gasoline engine, and the direct injection method is used mainly for a diesel engine, and is a method that directly injects fuel into a cylinder of the diesel engine.

However, technology adopting the direct injection method for the gasoline engine for the purpose of improving fuel efficiency and output enhancement and in order to prevent environmental contamination prevention has attracted attention. Such an engine is referred to as a gasoline direct injection (GDI) engine, and utilizes a method in which when an intake valve is opened, air is sucked from an intake port to a combustion chamber and compressed by a piston, and the fuel is directly injected to high-pressure air which flows into the combustion chamber.

An injector is installed in the GDI engine, which injects the fuel at high pressure. In the GDI engine, high fuel pressure becomes a very important element, and to this end, a high-performance fuel pump is required.

The above information disclosed in this Background section is only for enhancement of understanding of the background of the disclosure, and therefore it may contain information that does not form the prior art that is already known in this country to a person of ordinary skill in the art.

SUMMARY

The present disclosure provides a method and a device for detecting leakage of a high pressure fuel pump of a vehicle, which can detect (or check) a fuel leakage tendency of the high pressure fuel pump of the vehicle.

An exemplary embodiment of the present disclosure provides a method for detecting a leakage of a high pressure fuel pump of a vehicle, which may include: turning off, by a controller, starting of an engine of a vehicle based on an idle stop and go (ISG) function of the vehicle; after the starting of the engine is turned off, determining, by the controller, whether restarting of the engine occurs by a fuel rail pressure condition in which internal fuel pressure of a fuel rail connected between a high pressure fuel pump and an injector of the engine is less than or equal to reference pressure; when the restarting of the engine occurs by the fuel rail pressure condition, determining, by the controller, whether a reference pressure reach time of the internal fuel pressure of the fuel rail is less than or equal to a reference time; and when the reference pressure reach time of the internal fuel pressure of the fuel rail is less than or equal to the reference time, storing, by the controller, a number of times of restarting of the engine caused by the fuel rail pressure condition.

The method for detecting a leakage of a high pressure fuel pump of a vehicle may further include when the number of times of restarting of the engine is greater than or equal to a reference number of times, generating, by the controller, a message for requesting a user of the vehicle to check the high pressure fuel pump, through a display device of the vehicle.

When the starting of the engine is turned off, the controller may start calculation of the reference pressure reach time of the internal fuel pressure of the fuel rail by using a timer.

Another exemplary embodiment of the present disclosure provides a device for detecting a leakage of a high pressure fuel pump of a vehicle, which may include: a fuel rail configured to supply an injector of an engine with fuel compressed by a high pressure fuel pump; and a controller configured to turn off starting of the engine based on an idle stop and go (ISG) function of the vehicle, in which after the starting of the engine is turned off, the controller may determine whether restarting of the engine occurs by a fuel rail pressure condition in which internal fuel pressure of the fuel rail is less than or equal to reference pressure, when the restarting of the engine occurs by the fuel rail pressure condition, the controller may determine whether a reference pressure reach time of the internal fuel pressure of the fuel rail is less than or equal to a reference time, and when the reference pressure reach time of the internal fuel pressure of the fuel rail is less than or equal to the reference time, the controller may store a number of times of restarting of the engine caused by the fuel rail pressure condition.

When the number of times of restarting of the engine is greater than or equal to a reference number of times, the controller may generate a message for requesting a user of the vehicle to check the high pressure fuel pump, through a display device of the vehicle.

When the starting of the engine is turned off, the controller may start calculation of the reference pressure reach time of the internal fuel pressure of the fuel rail by using a timer.

According to an exemplary embodiment of the present disclosure, a method and a device for detecting a leakage of a high pressure fuel pump of a vehicle can detect (or check) a fuel leakage tendency of the high pressure fuel pump of the vehicle.

BRIEF DESCRIPTION OF THE DRAWINGS

A brief description of each drawing is provided in order to help more sufficient understanding of drawings used in a detailed description of the present disclosure.

DETAILED DESCRIPTION OF THE EMBODIMENTS

Figure 1:
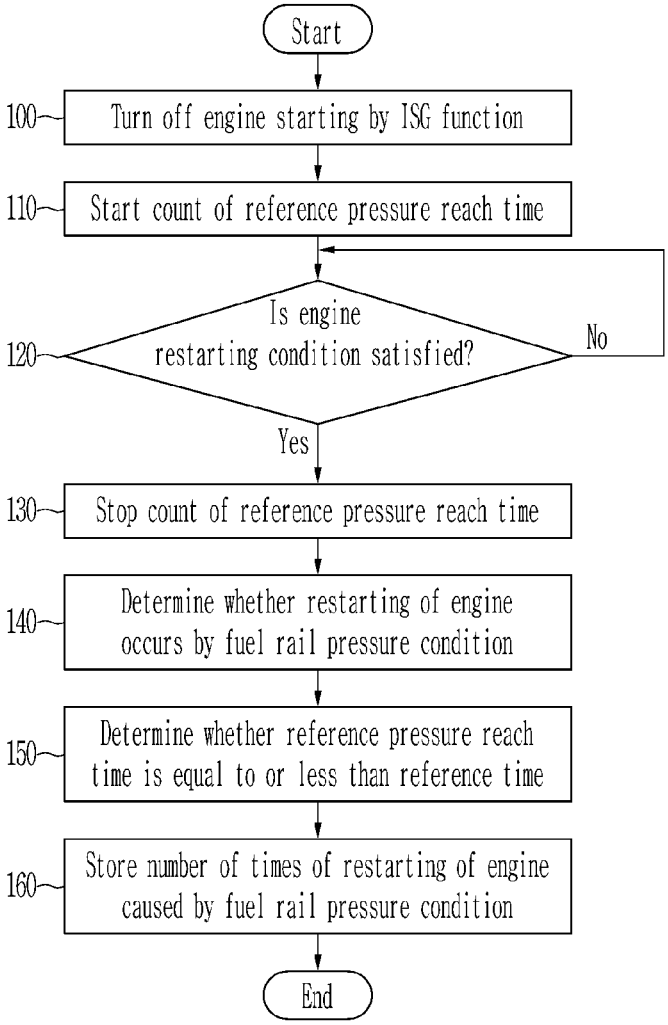
FIG. 1 is a flowchart for describing a method for detecting a leakage of a high pressure fuel pump of a vehicle according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example, both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

In order to sufficiently appreciate objects achieved by the present disclosure and exemplary embodiments of the present disclosure, accompanying drawings illustrating the exemplary embodiments of the present disclosure and contents disclosed in the accompanying drawings should be referred to.

Hereinafter, the present disclosure will be described in detail by describing the exemplary embodiments of the present disclosure with reference to the accompanying drawings. In the following description, a detailed explanation of related known configurations or functions may be omitted to avoid obscuring the subject matter of the present disclosure. Like reference numeral presented in each drawing may refer to like element.

Terms used in the present specification are used only to describe specific exemplary embodiments, and are not intended to limit the present disclosure. An expression in a singular form includes an expression in a plural form unless otherwise clearly defined in the context.

Throughout the specification, when it is described that a part is "connected" with another part, it includes a case where the parts may be "directly connected" with each other and a case where the parts are "electrically or mechanically connected" to each other with a still another element interposed therebetween.

Unless otherwise defined, all terms used herein including technological or scientific terms have the same meanings as those generally understood by those with ordinary skill in the art (those skilled in the art) to which the present disclosure pertains. Terms which are defined in a generally used dictionary should be interpreted to have the same meaning as the meaning in the context of the related art, and are not interpreted as an ideal meaning or excessively formal meanings unless clearly defined in the present specification.

A test device according to the related art may not detect a fuel leakage tendency of a high pressure fuel pump that provides high-pressure fuel to a combustion chamber of an engine of a vehicle.

Figure 2:
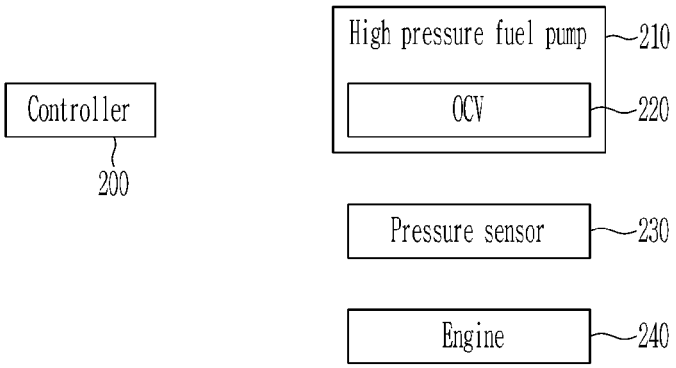
FIG. 2 is a diagram for describing a device for detecting the leakage of the high pressure fuel pump of the vehicle, to which the method for detecting the leakage of the high pressure fuel pump of the vehicle, which is illustrated in FIG. 1, is applied.

FIG. 1 is a flowchart for describing a method for detecting a leakage of a high pressure fuel pump of a vehicle according to an exemplary embodiment of the present disclosure. FIG. 2 is a diagram for describing a device for detecting the leakage of the high pressure fuel pump of the vehicle, to which the method for detecting the leakage of the high pressure fuel pump of the vehicle, which is illustrated in FIG. 1, is applied.

Referring to FIGS. 1 and 2, in a start-off step 100, a controller 200 may turn off starting of an engine 240 of a vehicle based on an idle stop and go (ISG) function of the vehicle. The ISG function may refer to a function to prevent combustion of the engine by stopping driving of the engine 240 when the vehicle stops, and to enable movement of the vehicle by driving the engine again when the vehicle starts to move. Additionally, the ISG function may refer to a function to automatically stop the engine 240 by preventing fuel injection when the vehicle stops while traveling, and automatically restart the engine by a start generator at the time when the vehicle restarts from a stop state (for example, when a driver or a user of the vehicle releases his/her foot from a brake pedal and steps on an accelerator).

The device for detecting a leakage of a high pressure fuel pump of a vehicle may include the controller 200, a high pressure fuel pump 210, a pressure sensor 230, and the engine 240 such as a gasoline direct injection (GDI) engine.

The controller 200 as an electronic control unit (ECU) may control an overall operation of the device for detecting a leakage of a high pressure fuel pump of a vehicle. The controller 200 may be, for example, one or more microprocessors which operate by a program (control logic) or hardware (e.g., a microcomputer) including the microprocessors, and the program may include a series of instructions for performing the method for detecting a leakage of a high pressure fuel pump of a vehicle according to an exemplary embodiment of the present disclosure. The instructions may be stored in a memory of the device for detecting a leakage of the high pressure fuel pump 210 of the vehicle or the controller 200.

According to step 110, when starting of the engine 240 is turned off, the controller 200 may start a count (calculation) of a reference pressure reach time of a fuel rail connected (disposed) between the high pressure fuel pump 210 and an injector of the engine 240 by using a timer. Internal fuel pressure of the fuel rail may be measured (detected) by the pressure sensor 230, and the measured (detected) fuel pressure may be provided to the controller 200. The fuel rail may supply high-pressure (e.g., pressure larger than 240 bar) fuel compressed by the high pressure fuel pump 210 to the injector that supplies the fuel to the combustion chamber of the engine 240. The high pressure fuel pump 210 may receive the fuel from a fuel tank of the vehicle.

According to step 120, after step 110, the controller 200 may determine whether a restarting condition of the engine 240 is satisfied. For example, when the restarting condition of the engine 240 may include a fuel rail pressure condition in which an internal fuel pressure of the fuel rail is less than or equal to a reference pressure or a case where a driver of the vehicle releases his/her foot from a brake pedal. The reference pressure may be a minimum value of the internal fuel pressure of the fuel rail, which enables restarting (or starting) of the vehicle and may be determined by a test (or experiment).

According to step 130, when the restarting condition of the engine 240 is satisfied and the engine is restarted, the controller 200 may stop the count (calculation) of the reference pressure reach time of the internal fuel pressure of the fuel rail.

According to step 140, after step 130, the controller 200 may determine whether the restarting of the engine 240 occurs by the fuel rail pressure condition. For example, the controller 200 may determine whether the restarting of the engine 240 occurs by the fuel rail pressure condition based on an output signal of a sensor for detecting an operation (or state) of the device (e.g., brake pedal or fuel rail) of the vehicle.

According to step 150, when the restarting of the engine 240 occurs by the fuel rail pressure condition, the controller 200 may determine whether the reference pressure reach time of the internal fuel pressure of the fuel rail is less than or equal to a reference time. The reference time may be determined by the test (or experiment). When the reference pressure reach time of the internal fuel pressure of the fuel rail is less than or equal to the reference time, it may be determined that fuel leakage performance of the high pressure fuel pump 210 deteriorates. A fuel leakage of the high pressure fuel pump 210 may occur when fuel discharged (leaked) to the fuel rail through a ball of an outlet check valve (OCV) 220 included in the high pressure fuel pump flows backward through the ball of the outlet check valve. When the fuel flows backward through the ball of the outlet check valve, a pressure at an outlet of the high pressure fuel pump 210 may be reduced. A structure of the outlet check valve 220 may be known technology.

According to step 160, when the reference pressure reach time of the internal fuel pressure of the fuel rail is less than or equal to the reference time, the controller 200 may store, in the memory, a number of times of restarting of the engine 240 caused by the fuel rail pressure condition.

When the number of times of restarting of the engine 240 is greater than or equal to a reference number of times, the controller 200 may generate a message for requesting a user of the vehicle to check the high pressure fuel pump 210, through a display device of the vehicle. The reference number of times may be determined by the test (or experiment).

A component, "unit," block, or module used in the exemplary embodiment of the present disclosure may be implemented as software such as a task, a class, a sub routine, a process, an object, an execution thread, and a program performed in a predetermined area on a memory or hardware such as field programmable gate array (FPGA) or application-specific integrated circuit (ASIC), and further, may be achieved by a combination of the software and the hardware. The component or unit may be included in a computer readable storage medium, and some of the component(s) or unit(s) may be dispersedly distributed in a plurality of computers.

As described above, the embodiment is disclosed in the drawings and the specification. Although specific terms have been used herein, the terms are only used for the purpose of describing the present disclosure and are not used to limit the meanings thereof or the scope of the present disclosure as defined in the claims. Therefore, those skilled in the art will be able to appreciate that various modifications and equivalent embodiments can be made from the present disclosure. Accordingly, the true technical scope of the present disclosure should be defined by the technical spirit of the appended claims.

What is claimed is:

1. A method for detecting a leakage of a high pressure fuel pump of a vehicle, the method comprising:

turning off, by a controller, starting of an engine of the vehicle based on an idle stop and go (ISG) function of the vehicle;

after the starting of the engine is turned off, determining, by the controller, whether restarting of the engine occurs by a fuel rail pressure condition in which internal fuel pressure of a fuel rail connected between the high pressure fuel pump and an injector of the engine is less than or equal to reference pressure;

when the restarting of the engine occurs by the fuel rail pressure condition, determining, by the controller, whether a reference pressure reach time of the internal fuel pressure of the fuel rail is less than or equal to a reference time; and when the reference pressure reach time of the internal fuel pressure of the fuel rail is less than or equal to the reference time, storing, by the controller, a number of times of restarting of the engine caused by the fuel rail pressure condition.

2. The method of claim 1, further comprising:

when the number of times of restarting of the engine is greater than or equal to a reference number of times, generating, by the controller, a message for requesting a user of the vehicle to check the high pressure fuel pump, through a display device of the vehicle.

3. The method of claim 1, wherein:

when the starting of the engine is turned off, starting, by the controller, calculation of the reference pressure reach time of the internal fuel pressure of the fuel rail by using a timer.

4. A device for detecting a leakage of a high pressure fuel pump of a vehicle, the device comprising:

a fuel rail configured to supply an injector of an engine with fuel compressed by the high pressure fuel pump; and a controller configured to turn off starting of the engine based on an idle stop and go (ISG) function of the vehicle, wherein after the starting of the engine is turned off, the controller determines whether restarting of the engine occurs by a fuel rail pressure condition in which internal fuel pressure of the fuel rail is less than or equal to reference pressure, when the restarting of the engine occurs by the fuel rail pressure condition, the controller determines whether a reference pressure reach time of the internal fuel pressure of the fuel rail is less than or equal to a reference time, and when the reference pressure reach time of the internal fuel pressure of the fuel rail is less than or equal to the reference time, the controller stores a number of times of restarting of the engine caused by the fuel rail pressure condition.

5. The device of claim 4, wherein:

when the number of times of restarting of the engine is greater than or equal to a reference number of times, the controller generates a message for requesting a user of the vehicle to check the high pressure fuel pump, through a display device of the vehicle.

6. The device of claim 4, wherein:

when the starting of the engine is turned off, the controller starts calculation of the reference pressure reach time of the internal fuel pressure of the fuel rail by using a timer.

* * * * *